US011351774B2

(12) United States Patent
Oikawa et al.

(10) Patent No.: US 11,351,774 B2
(45) Date of Patent: Jun. 7, 2022

(54) PRINTING APPARATUS AND DISCHARGE STATUS JUDGMENT METHOD

(71) Applicant: CANON KABUSHIKI KAISHA, Tokyo (JP)

(72) Inventors: Yuhei Oikawa, Yokohama (JP); Toshiyuki Chikuma, Tokyo (JP); Yutaka Kano, Kawasaki (JP); Kohei Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/897,477

(22) Filed: Jun. 10, 2020

(65) Prior Publication Data

US 2020/0298555 A1 Sep. 24, 2020

Related U.S. Application Data

(63) Continuation of application No. 16/361,380, filed on Mar. 22, 2019, now Pat. No. 10,766,251.

(30) Foreign Application Priority Data

Mar. 28, 2018 (JP) ..... JP2018-062263

(51) Int. Cl.
*B41J 2/045* (2006.01)
*B41J 2/14* (2006.01)

(52) U.S. Cl.
CPC ..... *B41J 2/0451* (2013.01); *B41J 2/0458* (2013.01); *B41J 2/04563* (2013.01); *B41J 2002/14354* (2013.01)

(58) Field of Classification Search
CPC .... B41J 2/0451; B41J 2/04563; B41J 2/0458; B41J 2002/14354; B41J 2/05; B41J 29/393; B41J 2/07; G06F 3/121
(Continued)

(56) References Cited

U.S. PATENT DOCUMENTS 7,806,503 B2 10/2010 Aoki et al.
7,914,106 B2 3/2011 Tokabayashi et al.
(Continued)

FOREIGN PATENT DOCUMENTS

CN 1738714 A 2/2006
CN 1955002 A 5/2007
(Continued)

OTHER PUBLICATIONS

Office Action dated May 29, 2020, in Chinese Patent Application No. 201910235076.5.
(Continued)

*Primary Examiner* — Kristal Feggins
*Assistant Examiner* — Alexander D Shenderov
(74) *Attorney, Agent, or Firm* — Venable LLP

(57) ABSTRACT

A printing apparatus, which uses a printhead including a circuit configured to inspect an ink discharge status of a selected nozzle using a temperature detection element, causes the printhead to inspect the ink discharge status by changing a threshold value for judging a detection result of the temperature detection element, in order to judge the ink discharge status in a state in which a heater in the selected nozzle is driven by each of a first pulse and a second pulse whose waveform is different from that of the first pulse, obtains first information about a change point where a judgment result obtained by the first pulse changes, and second information about a change point where a judgment result obtained by the second pulse changes, and sets the threshold value, based on the first and second information.

23 Claims, 12 Drawing Sheets

(58) Field of Classification Search
USPC ..... 347/14
See application file for complete search history.

(56) References Cited

U.S. PATENT DOCUMENTS

| | | | |
|---|---|---|---|
| 7,935,389 | B2 | 5/2011 | Takahashi et al. |
| 8,186,798 | B2 | 5/2012 | Aoki et al. |
| 8,210,640 | B2 | 7/2012 | Takabayashi et al. |
| 8,287,082 | B2 | 10/2012 | Aoki et al. |
| 8,439,468 | B2 | 5/2013 | Yokozawa et al. |
| 8,814,296 | B2 | 8/2014 | Yazawa et al. |
| 8,845,064 | B2 | 9/2014 | Ike |
| 8,950,843 | B2 | 2/2015 | Oikawa et al. |
| 9,033,442 | B2 | 5/2015 | Kanno et al. |
| 9,114,611 | B2 | 8/2015 | Ike |
| 9,205,644 | B2 | 12/2015 | Hosokawa |
| 9,492,997 | B2 | 11/2016 | Zhang et al. |
| 9,636,907 | B2 | 5/2017 | Shinkawa et al. |
| 9,981,465 | B1 | 5/2018 | Mu et al. |
| 10,099,473 | B2 | 10/2018 | Anderson et al. |
| 2006/0250465 | A1 | 11/2006 | Anderson et al. |
| 2007/0064040 | A1 | 3/2007 | Kim |
| 2007/0291066 | A1* | 12/2007 | Takabayashi ..... B41J 2/17509 347/17 |
| 2007/0291081 | A1 | 12/2007 | Kanno et al. |
| 2010/0053249 | A1 | 3/2010 | Matsushita et al. |
| 2010/0149237 | A1 | 6/2010 | Takabayashi et al. |
| 2010/0156978 | A1 | 6/2010 | Yokozawa et al. |
| 2010/0156982 | A1 | 6/2010 | Sasagawa |
| 2011/0211000 | A1 | 9/2011 | Aoki et al. |
| 2011/0261104 | A1 | 10/2011 | Tatsumi |
| 2012/0194591 | A1 | 8/2012 | Hagiwara |
| 2012/0306953 | A1 | 12/2012 | Kanno et al. |
| 2017/0305146 | A1 | 10/2017 | Mihailovic et al. |
| 2019/0299601 | A1 | 10/2019 | Oikawa et al. |
| 2020/0023638 | A1 | 1/2020 | Anderson et al. |

FOREIGN PATENT DOCUMENTS

| | | | |
|---|---|---|---|
| CN | 101092082 | A | 12/2007 |
| CN | 101665021 | A | 3/2010 |
| CN | 103042827 | A | 4/2013 |
| CN | 103129143 | A | 6/2013 |
| CN | 103395291 | A | 11/2013 |
| CN | 104097398 | A | 10/2014 |
| CN | 104441991 | A | 3/2015 |
| CN | 105939858 | A | 9/2016 |
| CN | 106004047 | A | 10/2016 |
| JP | 2003-291349 | A | 10/2003 |
| JP | 2008-000914 | A | 1/2008 |

OTHER PUBLICATIONS

Office Action dated Jul. 3, 2020, in Chinese Patent Application No. 201910235075.0.
Extended European Search Report dated Aug. 5, 2019, in European Patent Application No. 19162249.7.
Extended European Search Report dated Aug. 5, 2019, in European Patent Application No. 19162257.0.
Office Action dated Mar. 22, 2022, in Korean Patent Application No. 10-2019-0034901.

* cited by examiner

FIG. 11A DISCHARGE INSPECTION THRESHOLD VOLTAGE CORRESPONDING TO CHANGE POINT OF INSPECTION RESULT

FIG. 11B DISCHARGE DIFFERENCE BETWEEN INSPECTION THRESHOLD VOLTAGES CORRESPONDING TO CHANGE POINTS OF INSPECTION RESULTS

FIG. 11C JUDGMENT RESULT OF DISCHARGE INSPECTION TO BE STORED IN EEPROM

PRINTING APPARATUS AND DISCHARGE STATUS JUDGMENT METHOD

BACKGROUND OF THE INVENTION

Field of the Invention

The present invention relates to a printing apparatus and a discharge status judgment method and, more particularly, to, for example, a printing apparatus to which a printhead incorporating an element substrate with a plurality of print elements is applied to perform printing in accordance with an inkjet method, and a discharge status judgment method.

Description of the Related Art

One of inkjet printing methods of discharging ink droplets from nozzles and adhering them to a paper sheet, a plastic film, or another print medium uses a printhead with print elements that generate thermal energy to discharge ink. As for a printhead according to this method, an electrothermal transducer that generates heat in accordance with supply of an electric current, a drive circuit for it, and the like can be formed using the same process as a semiconductor manufacturing process. Therefore, this has the advantage in that high density implementation of nozzles is easy and higher-resolution printing can be achieved.

In this printhead, an ink discharge failure may occur in all or some of the nozzles of the printhead due to a factor such as clogging of a nozzle caused by a foreign substance or ink whose viscosity increases, bubbles trapped in an ink supply channel or a nozzle, or a change in wettability on a nozzle surface. To avoid degradation in image quality caused when such discharge failure occurs, a recovery operation of recovering an ink discharge status and a complementary operation by other nozzles are preferably, quickly executed. However, to execute these operations quickly, it is very important to correctly and appropriately judge the ink discharge status and the occurrence of the discharge failure.

Taking this background into consideration, there are conventionally proposed various ink discharge status judgment methods and complementary printing methods, and apparatuses to which these methods are applied.

Japanese Patent Laid-Open No. 2008-000914 discloses a method of detecting a decrease in temperature at the time of normal discharge to detect a failure of ink discharge from a printhead. According to Japanese Patent Laid-Open No. 2008-000914, at the time of normal discharge, a point (feature point) at which a temperature drop rate changes appears after a predetermined time elapses after the time when a detected temperature reaches a highest temperature but no such point appears at the time of a discharge failure. Therefore, the ink discharge status is judged by detecting the presence/absence of the feature point. Furthermore, Japanese Patent Laid-Open No. 2008-000914 discloses an arrangement in which a temperature detection element is provided immediately below a print element that generates thermal energy for ink discharge, and discloses, as a method of detecting the presence/absence of the feature point, a method of detecting the feature point as a peak value by differential processing of a change in temperature.

The discharge status judgment method disclosed in Japanese Patent Laid-Open No. 2008-000914 assumes the arrangement in which the temperature detection element is provided immediately below the print element that generates thermal energy for ink discharge. Thus, the sensitivity of the temperature detection element changes due to a temporal change in resistance value of the temperature detection element, which is caused by the influence of heat generated at the time of ink discharge or a change in status of a protection film for protecting the print element, which is caused by repeating an ink discharge operation. This means that the detected temperature of the temperature detection element varies in accordance with the use of the print element. As a result of the variation, it is assumed that it becomes impossible to judge the ink discharge status correctly.

SUMMARY OF THE INVENTION

Accordingly, the present invention is conceived as a response to the above-described disadvantages of the conventional art.

For example, a printing apparatus and a discharge status judgment method according to this invention are capable of, for example, judging an ink discharge status correctly even if the sensitivity of a temperature detection element changes due to the use of a print element.

According to one aspect of the present invention, there is provided a printing apparatus comprising: a printhead including a plurality of nozzles each configured to discharge ink, a plurality of heaters respectively provided in the plurality of nozzles and each configured to heat the ink, a plurality of temperature detection elements provided in correspondence with the plurality of heaters, and an inspection circuit configured to inspect ink discharge statuses of the plurality of nozzles using the plurality of temperature detection elements: a selection unit configured to select, from the plurality of nozzles of the printhead, a nozzle as a target of inspection of the ink discharge status; a drive unit configured to drive, by one of a first pulse and a second pulse whose waveform is different from that of the first pulse, the heater provided in the nozzle selected by the selection unit; an inspection unit configured to cause the printhead to inspect the ink discharge status by changing stepwise a threshold value used for judging a temperature detection result of a temperature detection element corresponding to the nozzle selected by the selection unit, in order to judge the ink discharge status of the nozzle selected by the selection unit in a state in which the heater provided in the nozzle selected by the selection unit is driven by the drive unit by each of the first pulse and the second pulse; an obtaining unit configured to obtain, for the selected nozzle, first information about a change point at which a judgment result obtained by inspecting the ink discharge status by the inspection unit changes in the state in which the heater provided in the selected nozzle is driven by the drive unit by the first pulse, and second information about a change point at which a judgment result obtained by inspecting the ink discharge status by the inspection unit changes in the state in which the heater provided in the selected nozzle is driven by the drive unit by the second pulse; and a setting unit configured to set, based on the first information and the second information obtained by the obtaining unit, the threshold value for judging the ink discharge status of the nozzle selected by the selection unit.

According to another aspect of the present invention, there is provided a discharge status judgment method for a printing apparatus comprising a printhead including a plurality of nozzles each configured to discharge ink, a plurality of heaters respectively provided in the plurality of nozzles and each configured to heat the ink, a plurality of temperature detection elements provided in correspondence with the plurality of heaters, and an inspection circuit configured to inspect ink discharge statuses of the plurality of nozzles using the plurality of temperature detection elements, the method comprising: selecting, from the plurality of nozzles of the printhead, a nozzle as a target of inspection of the ink discharge status; causing the printhead to inspect the ink discharge status by changing stepwise a threshold value used for judging a temperature detection result of a temperature detection element corresponding to the selected nozzle, in order to judge the ink discharge status of the selected nozzle in a state in which the heater provided in the selected nozzle is driven by a first pulse; causing the printhead to inspect the ink discharge status by changing stepwise the threshold value in order to judge the ink discharge status of the selected nozzle in a state in which the heater provided in the selected nozzle is driven by a second pulse whose waveform is different from that of the first pulse; obtaining, for the selected nozzle, first information about a change point at which a judgment result obtained by inspecting the ink discharge status using the first pulse changes, and second information about a change point at which a judgment result obtained by inspecting the ink discharge status using the second pulse changes; and setting, based on the obtained first information and second information, the threshold value for judging the ink discharge status of the selected nozzle.

The invention is particularly advantageous since it is possible to judge an ink discharge status correctly even if the sensitivity of a temperature detection element changes due to the use of a print element.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, unless otherwise specified, and a "print element" is provided in correspondence to an orifice, and means an element for generating energy used to discharge ink. For example, the print element may be provided in a position opposing to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

Figure 1:
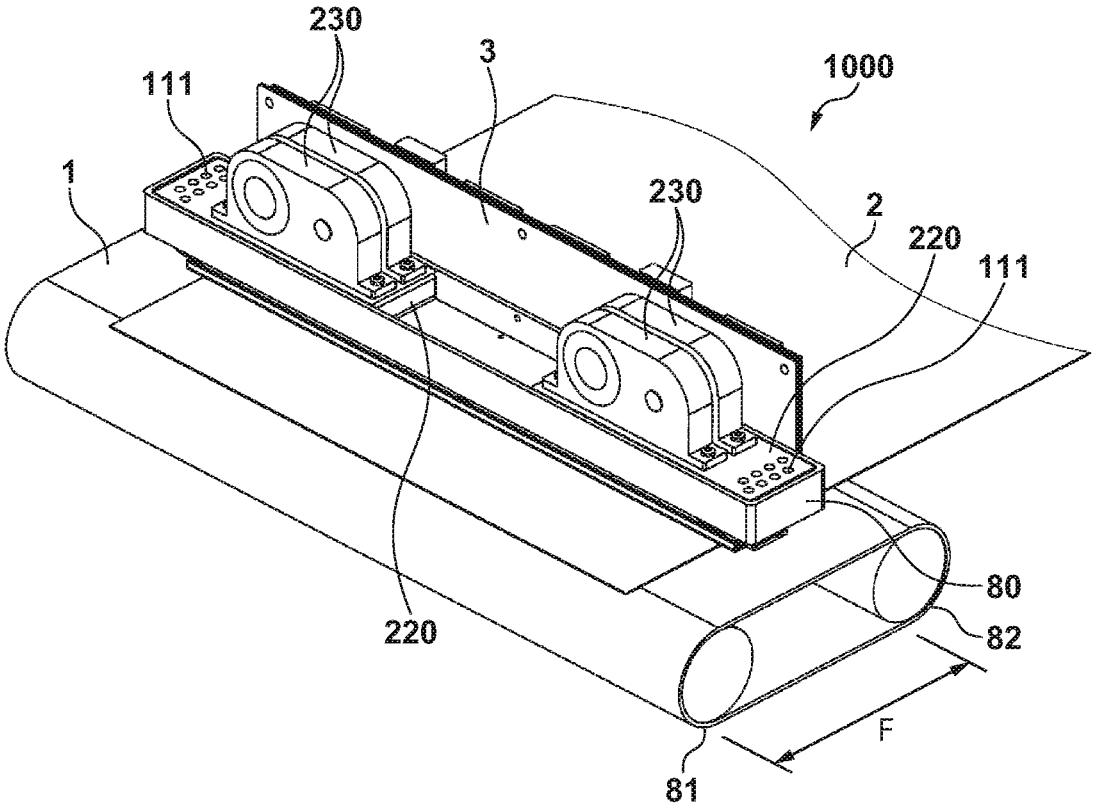
FIG. 1 is a perspective view for explaining the structure of a printing apparatus including a full-line printhead according to an exemplary embodiment of the present invention.

Printing Apparatus Mounted with Full-Line Printhead (FIG. 1)

FIG. 1 is a perspective view showing the schematic arrangement of a printing apparatus 1000 using a full-line printhead that performs printing by discharging ink according to an exemplary embodiment of the present invention.

As shown in FIG. 1, the printing apparatus 1000 is a line type printing apparatus that includes a conveyance unit 1 that conveys a print medium 2 and a full-line printhead 3 arranged to be approximately orthogonal to the conveyance direction of the print medium 2, and performs continuous printing while conveying the plurality of print media 2 continuously or intermittently. The full-line printhead 3 includes ink orifices arrayed in a direction intersecting the conveyance direction of the printing medium. The full-line printhead 3 is provided with a negative pressure control unit 230 that controls the pressure (negative pressure) in an ink channel, a liquid supply unit 220 that communicates with the negative pressure control unit 230, and a liquid connecting portion 111 that serves as an ink supply and discharge port to the liquid supply unit 220.

A housing 80 is provided with the negative pressure control unit 230, the liquid supply unit 220, and the liquid connecting portion 111.

Note that the print medium 2 is not limited to a cut sheet, and may be a continuous roll sheet.

The full-line printhead (to be referred to as the printhead hereinafter) 3 can perform full-color printing by cyan (C), magenta (M), yellow (Y), and black (K) inks. A main tank and the liquid supply unit 220 serving as a supply channel for supplying ink to the printhead 3 are connected to the printhead 3. An electric controller (not shown) that transmits power and a discharge control signal to the printhead 3 is electrically connected to the printhead 3.

The print medium 2 is conveyed by rotating two conveyance rollers 81 and 82 provided apart from each other by a distance of F in the conveyance direction of the print medium 2.

The printhead 3 according to this embodiment employs the inkjet method of discharging ink using thermal energy. Therefore, each orifice of the printhead 3 includes an electrothermal transducer (heater). The electrothermal transducer is provided in correspondence with each orifice. When a pulse voltage is applied to the corresponding electrothermal transducer in accordance with a print signal, ink is heated and discharged from the corresponding orifice. Note that the printing apparatus is not limited to the above-described printing apparatus using the full-line printhead whose printing width corresponds to the width of the print medium. For example, the present invention is also applicable to a so-called serial type printing apparatus that mounts, on a carriage, a printhead in which orifices are arrayed in the conveyance direction of the print medium and performs printing by discharging ink to the print medium while reciprocally scanning the carriage.

Figure 2:
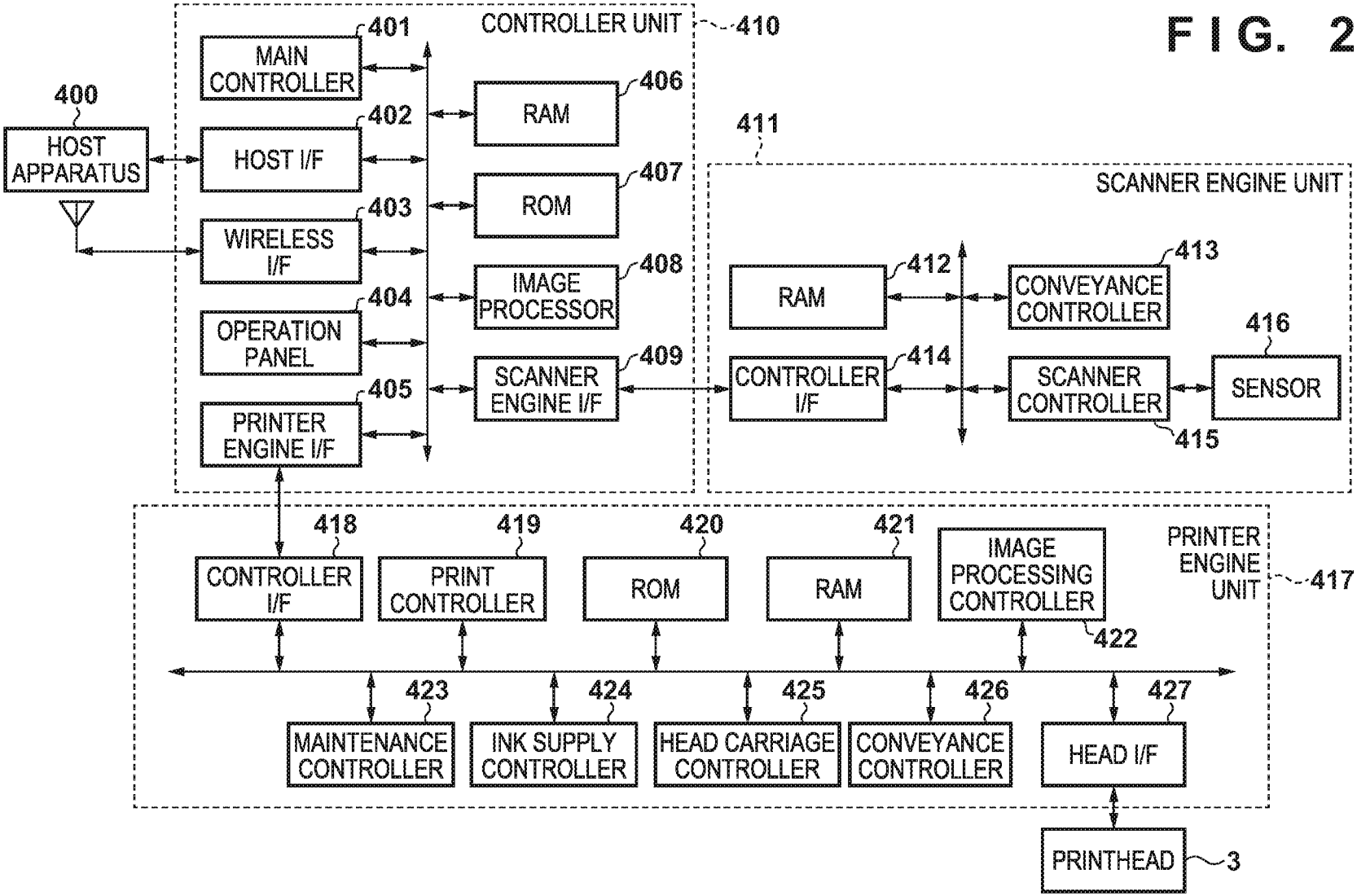
FIG. 2 is a block diagram showing the control arrangement of the printing apparatus shown in FIG. 1.

Explanation of Control Arrangement (FIG. 2)

FIG. 2 is a block diagram showing the arrangement of the control circuit of the printing apparatus 1000.

As shown in FIG. 2, the printing apparatus 1000 is formed by a printer engine unit 417 that mainly controls a printing unit, a scanner engine unit 411 that controls a scanner unit, and a controller unit 410 that controls the overall printing apparatus 1000. A print controller 419 integrating an MPU and a non-volatile memory (EEPROM or the like) controls various mechanisms of the printer engine unit 417 in accordance with an instruction from a main controller 401 of the controller unit 410. The various mechanisms of the scanner engine unit 411 are controlled by the main controller 401 of the controller unit 410.

Details of the control arrangement will be described below.

In the controller unit 410, the main controller 401 formed by a CPU controls the overall printing apparatus 1000 by using a RAM 406 as a work area in accordance with a program and various parameters stored in a ROM 407. For example, if a print job is input from a host apparatus 400 via a host I/F 402 or a wireless I/F 403, an image processor 408 performs predetermined image processing for received image data in accordance with an instruction from the main controller 401. The main controller 401 transmits, to the printer engine unit 417 via a printer engine I/F 405, the image data having undergone the image processing.

Note that the printing apparatus 1000 may obtain image data from the host apparatus 400 via wireless or wired communication, or obtain image data from an external storage device (USB memory or the like) connected to the printing apparatus 1000. A communication method used for wireless or wired communication is not limited. For example, as a communication method used for wireless communication, Wi-Fi (Wireless Fidelity)® or Bluetooth® is applicable. Furthermore, as a communication method used for wired communication, USB (Universal Serial Bus) or the like is applicable. For example, if a read command is input from the host apparatus 400, the main controller 401 transmits the command to the scanner engine unit 411 via a scanner engine I/F 409.

An operation panel 404 is a unit used by the user to perform an input/output operation for the printing apparatus 1000. The user can instruct an operation such as a copy or scan operation via the operation panel 404, set a print mode, and recognize information from the printing apparatus 1000.

In the printer engine unit 417, the print controller 419 formed by a CPU controls the various mechanisms of the printer engine unit 417 by using a RAM 421 as a work area in accordance with a program and various parameters stored in a ROM 420.

Upon receiving various commands or image data via a controller I/F 418, the print controller 419 temporarily saves the received data in the RAM 421. So as to use the printhead 3 for a print operation, the print controller 419 causes an image processing controller 422 to convert the saved image data into print data. When the print data is generated, the print controller 419 causes, via a head I/F 427, the printhead 3 to execute a print operation based on the print data. At this time, the print controller 419 drives the conveyance rollers 81 and 82 via a conveyance controller 426 to convey the print medium 2. In accordance with an instruction from the print controller 419, a print operation is executed by the printhead 3 in synchronism with the conveyance operation of the print medium 2, thereby performing print processing.

A head carriage controller 425 changes the orientation and position of the printhead 3 in accordance with an operation status such as the maintenance status or print status of the printing apparatus 1000. An ink supply controller 424 controls the liquid supply unit 220 so that the pressure of ink supplied to the printhead 3 falls within an appropriate range. A maintenance controller 423 controls the operation of a cap unit or wiping unit in a maintenance unit (not shown) when performing a maintenance operation for the printhead 3.

In the scanner engine unit 411, the main controller 401 controls the hardware resources of a scanner controller 415 by using the RAM 406 as a work area in accordance with a program and various parameters stored in the ROM 407. This controls the various mechanisms of the scanner engine unit 411. For example, the main controller 401 controls the hardware resources in the scanner controller 415 via a controller I/F 414, and conveys, via a conveyance controller 413, a document stacked on an ADF (not shown) by the user, thereby reading the document by a sensor 416. Then, the scanner controller 415 saves read image data in a RAM 412.

Note that the print controller 419 can cause the printhead 3 to execute a print operation based on the image data read by the scanner controller 415 by converting, into print data, the image data obtained as described above.

Figures 3A, 3B, 3C:
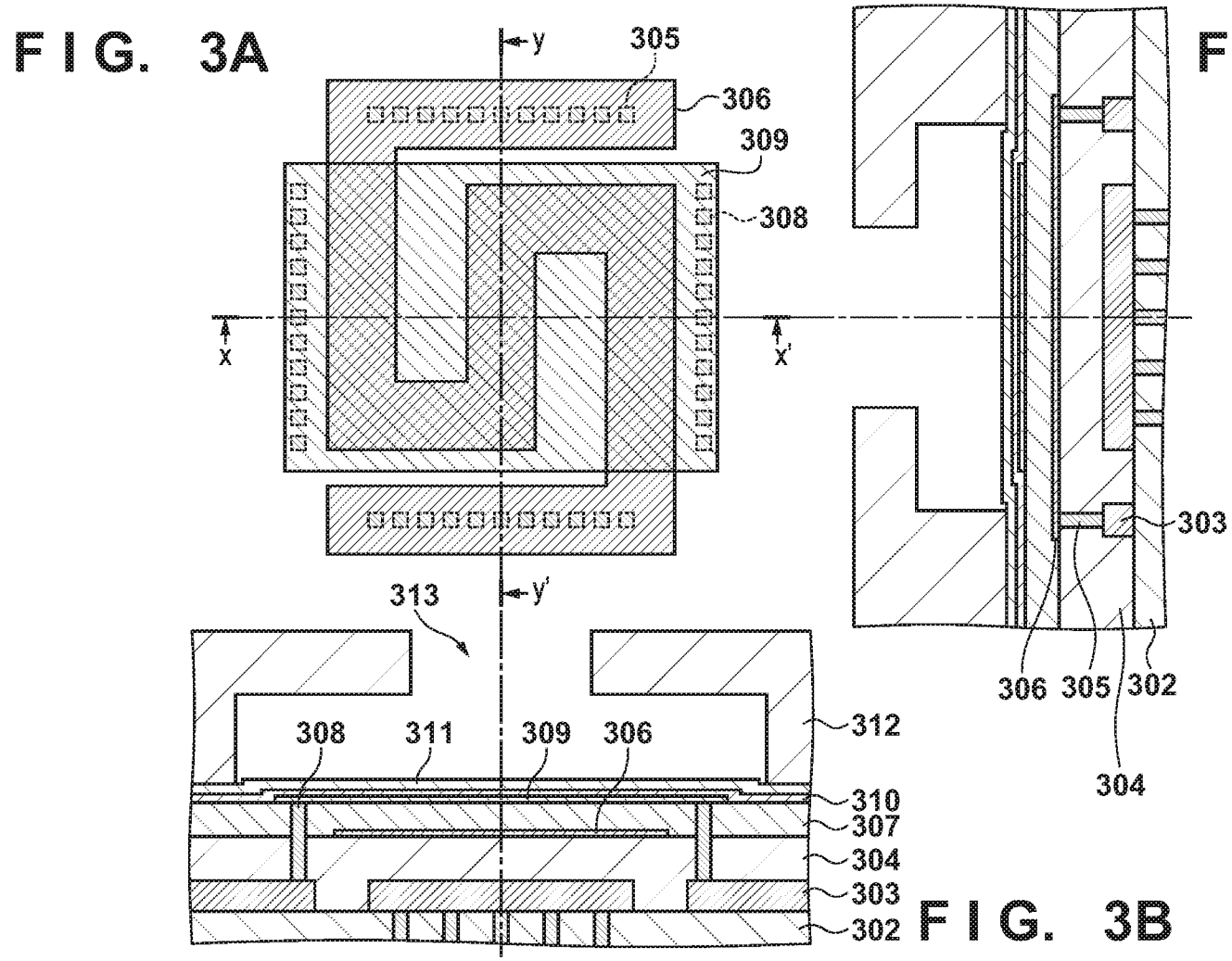
FIGS. 3A, 3B, and 3C are views each showing the multilayer wiring structure near a print element formed on a silicon substrate.

Explanation of Arrangement of Temperature Detection Element (FIGS. 3A to 3C)

FIGS. 3A to 3C are views each showing the multilayer wiring structure near a print element formed on a silicon substrate.

FIG. 3A is a plan view showing a state in which a temperature detection element 306 is arranged in the form of a sheet in a layer below a print element 309 via an interlayer insulation film 307. FIG. 3B is a sectional view taken along a broken line x-x' in the plan view shown in FIG. 3A. FIG. 3C is another sectional view taken along a broken line y-y' shown in FIG. 3A.

In the x-x' sectional view shown in FIG. 3B and the y-y' sectional view shown in FIG. 3C, a wiring 303 made of aluminum or the like is formed on an insulation film 302 layered on the silicon substrate, and an interlayer insulation film 304 is further formed on the wiring 303. The wiring 303 and the temperature detection element 306 serving as a thin film resistor formed from a layered film of titanium and titanium nitride or the like are electrically connected via conductive plugs 305 which are embedded in the interlayer insulation film 304 and made of tungsten or the like.

Next, the interlayer insulation film 307 is formed above the temperature detection element 306. The wiring 303 and the print element 309 serving as a heating resistor formed by a tantalum silicon nitride film or the like are electrically connected via conductive plugs 308 which penetrate through the interlayer insulation film 304 and the interlayer insulation film 307, and made of tungsten or the like.

Note that when connecting the conductive plugs in the lower layer and those in the upper layer, they are generally connected by sandwiching a spacer formed by an intermediate wiring layer. When applied to this embodiment, since the film thickness of the temperature detection element serving as the intermediate wiring layer is as small as about several tens of nm, the accuracy of overetching control with respect to a temperature detection element film serving as the spacer is required in a via hole process. In addition, the thin film is also disadvantageous in pattern miniaturization of a temperature detection element layer. In consideration of this situation, in this embodiment, the conductive plugs which penetrate through the interlayer insulation film 304 and the interlayer insulation film 307 are employed.

To ensure the reliability of conduction in accordance with the depths of the plugs, in this embodiment, each conductive plug 305 which penetrates one interlayer insulation film has a bore of 0.4 μm, and each conductive plug 308 which penetrates two interlayer insulation films has a larger bore of 0.6 μm.

Next, a head substrate (element substrate) is obtained by forming a protection film 310 such as a silicon nitride film, and then forming an anti-cavitation film 311 that contains tantalum or the like on the protection film 310. Furthermore, an orifice 313 is formed by a nozzle forming material 312 containing a photosensitive resin or the like.

As described above, the multilayer wiring structure in which an independent intermediate layer of the temperature detection element 306 is provided between the layer of the wiring 303 and the layer of the print element 309 is employed.

With the above arrangement, in the element substrate used in this embodiment, it is possible to obtain, for each print element, temperature information by the temperature detection element provided in correspondence with each print element.

Based on the temperature information detected by the temperature detection element and a change in temperature, a logic circuit (inspection circuit) provided in the element substrate can obtain a judgment result signal RSLT indicating the status of ink discharge from the corresponding print element. The judgment result signal RSLT is a 1-bit signal, and "1" indicates normal discharge and "0" indicates a discharge failure.

Figure 4:
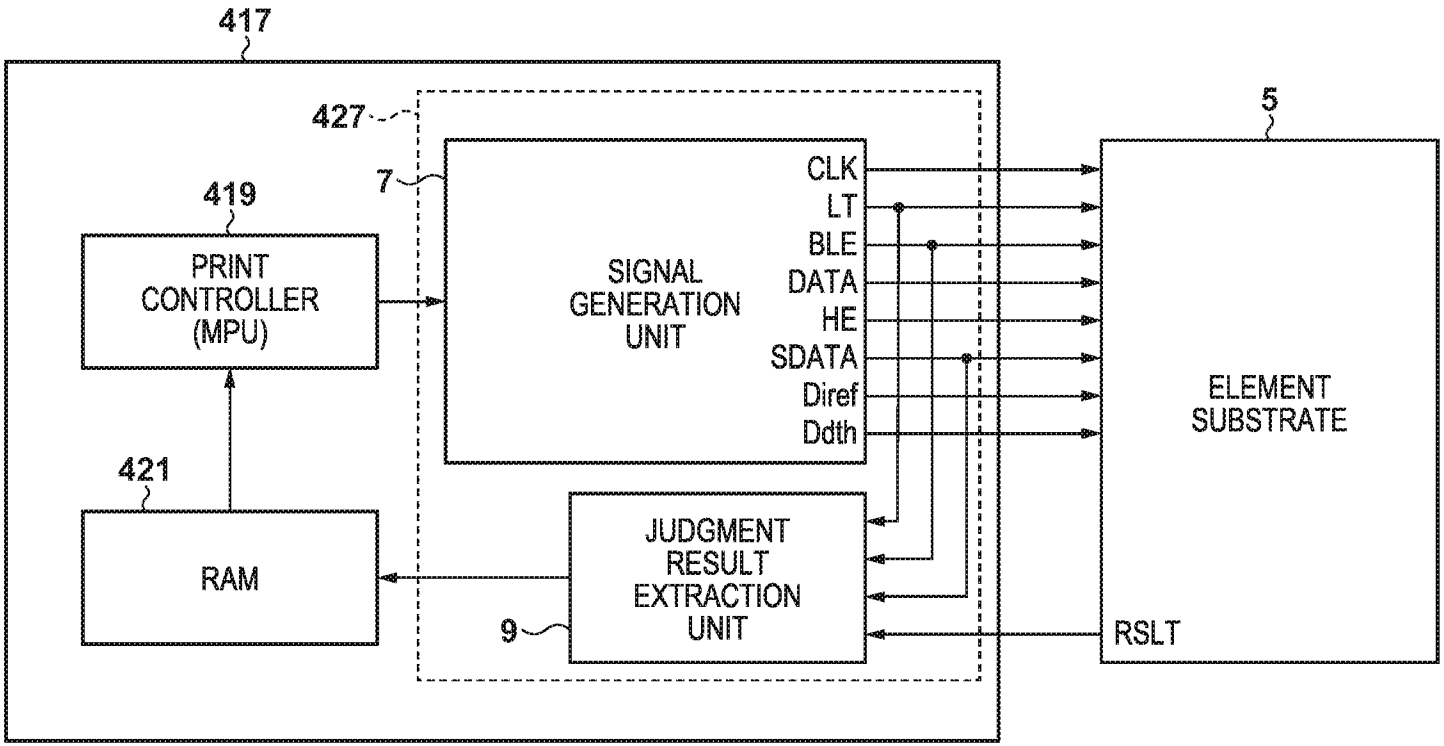
FIG. 4 is a block diagram showing a temperature detection control arrangement using the element substrate shown in FIGS. 3A, 3B, and 3C.

Explanation of Temperature Detection Arrangement (FIG. 4)

FIG. 4 is a block diagram showing a temperature detection control arrangement using the element substrate shown in FIGS. 3A to 3C.

As shown in FIG. 4, to detect the temperature of the print element integrated in an element substrate 5, the printer engine unit 417 includes the print controller 419 integrating the MPU, the head I/F 427 for connection to the printhead 3, and the RAM 421. Furthermore, the head I/F 427 includes a signal generation unit 7 that generates various signals to be transmitted to the element substrate 5, and a judgment result extraction unit 9 that receives the judgment result signal RSLT output from the element substrate 5 based on the temperature information detected by the temperature detection element 306.

For temperature detection, when the print controller 419 issues an instruction to the signal generation unit 7, the signal generation unit 7 outputs a clock signal CLK, a latch signal LT, a block signal BLE, a print data signal DATA, and a heat enable signal HE to the element substrate 5. The signal generation unit 7 also outputs a sensor selection signal SDATA, a constant current signal Diref, and a discharge inspection threshold signal Ddth.

The sensor selection signal SDATA includes selection information for selecting the temperature detection element to detect the temperature information, energization quantity designation information to the selected temperature detection element, and information pertaining to an output instruction of the judgment result signal RSLT. If, for example, the element substrate 5 is configured to integrate five print element arrays each including a plurality of print elements, the selection information included in the sensor selection signal SDATA includes array selection information for designating an array and print element selection information for designating a print element of the array. On the other hand, the element substrate 5 outputs the 1-bit judgment result signal RSLT based on the temperature information detected by the temperature detection element corresponding to the one print element of the array designated by the sensor selection signal SDATA.

Note that this embodiment employs an arrangement in which the 1-bit judgment result signal RSLT is output for the print elements of the five arrays. Therefore, in an arrangement in which the element substrate 5 integrates 10 print element arrays, the judgment result signal RSLT is a 2-bit signal, and this 2-bit signal is serially output to the judgment result extraction unit 9 via one signal line.

As is apparent from FIG. 4, the latch signal LT, the block signal BLE, and the sensor selection signal SDATA are fed back to the judgment result extraction unit 9. On the other hand, the judgment result extraction unit 9 receives the judgment result signal RSLT output from the element substrate 5 based on the temperature information detected by the temperature detection element, and extracts a judgment result during each latch period in synchronism with the fall of the latch signal LT. If the judgment result indicates a discharge failure, the block signal BLE and the sensor selection signal SDATA corresponding to the judgment result are stored in the RAM 421.

The print controller 419 erases a signal for the discharge failure nozzle from the print data signal DATA of a corresponding block based on the block signal BLE and the sensor selection signal SDATA which have been used to drive the discharge failure nozzle and stored in the RAM 421. The print controller 419 adds a nozzle for complementing a non-discharge nozzle to the print data signal DATA of the corresponding block instead, and outputs the signal to the signal generation unit 7.

Figure 5:
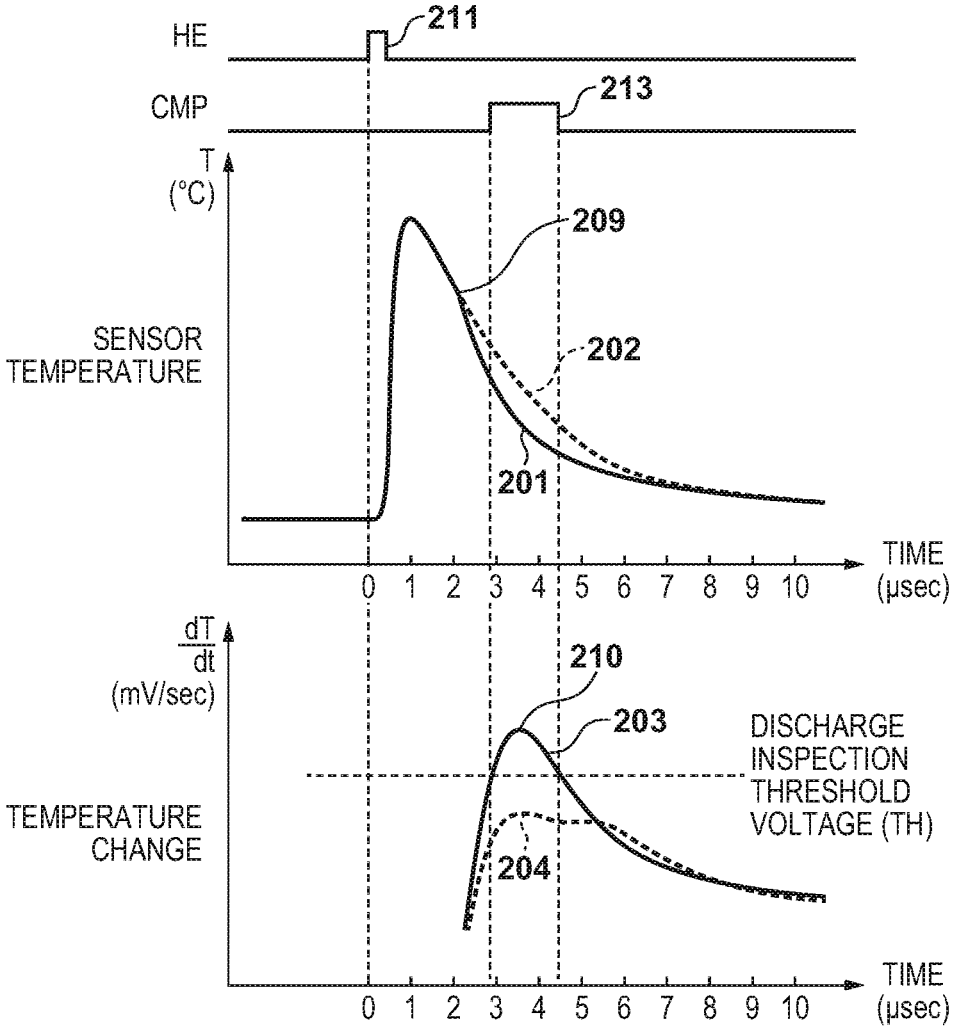
FIG. 5 is a view showing a temperature waveform output from a temperature detection element and a temperature change signal of the waveform when applying a drive pulse to the print element.
Figure 6A:
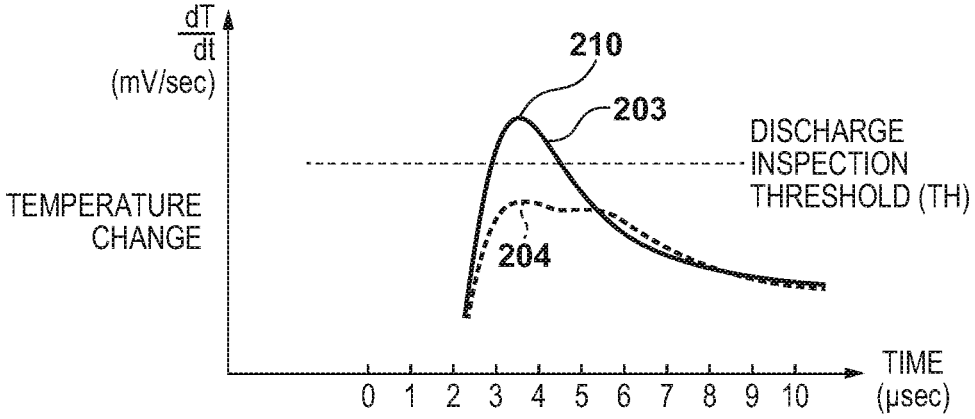
FIGS. 6A, 6B, and 6C are timing charts each showing the waveform of the temperature change signal (dT/dt) based on the temperature waveform signal detected by the temperature detection element.
Figure 6B:
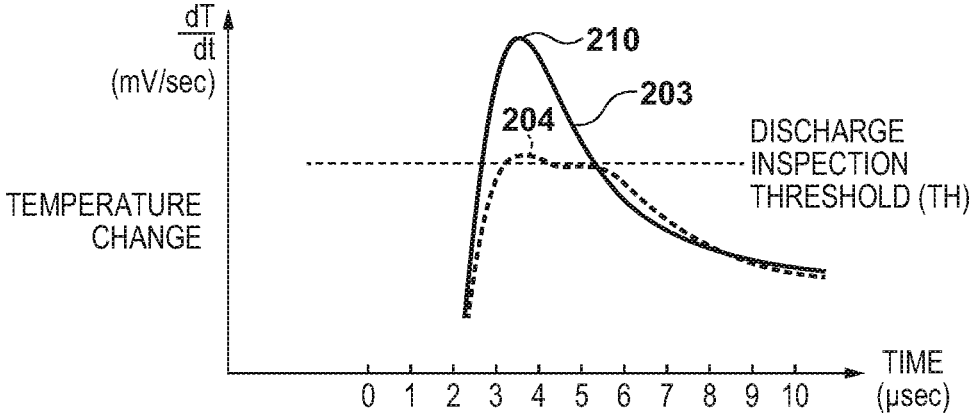
Figure 6C:
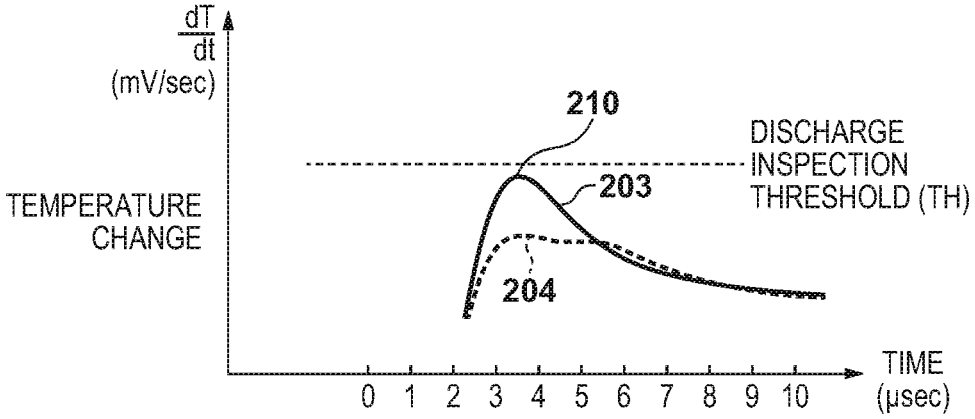

Explanation of Discharge Status Judgment Method (FIGS. 5 to 6C)

FIG. 5 is a view showing a temperature waveform (sensor temperature: T) output from a temperature detection element and a temperature change signal (dT/dt) of the waveform when applying a drive pulse to the print element.

Note that in FIG. 5, the temperature waveform (sensor temperature: T) is represented by a temperature (° C.). In fact, a constant current is supplied to the temperature detection element and a voltage (V) between the terminals of the temperature detection element is detected. Since this detected voltage has temperature dependence, the detected voltage is converted into a temperature and indicated as the temperature in FIG. 5. The temperature change signal (dT/dt) is indicated as a temporal change (mV/sec) in detected voltage.

As shown in FIG. 5, if ink is discharged normally when a driving pulse 211 is applied to the print element 309 (normal discharge), a waveform 201 is obtained as the output waveform of the temperature detection element 306. In a temperature drop process of the temperature detected by the temperature detection element 306, which is represented by the waveform 201, a feature point 209 appears when the tail (satellite) of an ink droplet discharged from the print element 309 drops to the interface of the print element 309 and cools the interface at the time of normal discharge. After the feature point 209, the waveform 201 indicates that the temperature drop rate increases abruptly. On the other hand, at the time of a discharge failure, a waveform 202 is obtained as the output waveform of the temperature detection element 306. Unlike the waveform 201 at the time of normal discharge, no feature point 209 appears, and the temperature drop rate gradually decreases in a temperature drop process.

The lowermost timing chart of FIG. 5 shows the temperature change signal (dT/dt), and a waveform 203 or 204 represents a waveform obtained after processing the output waveform 201 or 202 of the temperature detection element into the temperature change signal (dT/dt). A method of performing conversion into the temperature change signal at this time is appropriately selected in accordance with a system. The temperature change signal (dT/dt) according to this embodiment is represented by a waveform output after the temperature waveform is processed by a filter circuit (one differential operation in this arrangement) and an inverting amplifier.

In the waveform 203, a peak 210 deriving from the highest temperature drop rate after the feature point 209 of the waveform 201 appears. The waveform (dT/dt) 203 is compared with a discharge inspection threshold voltage (TH) preset in a comparator integrated in the element substrate 5, and a pulse indicating normal discharge in a period (dT/dt≥TH) in which the waveform 203 exceeds the discharge inspection threshold voltage (TH) appears in a judgment signal (CMP) 213.

On the other hand, since no feature point 209 appears in the waveform 202, the temperature drop rate is low, and the peak appearing in the waveform 204 is lower than the discharge inspection threshold voltage (TH). The waveform (dT/dt) 202 is also compared with the discharge inspection threshold voltage (TH) preset in the comparator integrated in the element substrate 5. In a period (dT/dt<TH) in which the waveform 202 is below the discharge inspection threshold voltage (TH), no pulse appears in the judgment signal (CMP) 213.

Therefore, by obtaining this judgment signal (CMP), it is possible to grasp the discharge status of each print element (nozzle). This judgment signal (CMP) serves as the above-described judgment result signal RSLT.

Note that if a pulse width of the driving pulse 211, whose energy is not enough to discharge ink, applied to the print element 309 is set, the feature point 209 does not appear in an output waveform from the temperature detection element 306 like a waveform in discharge failure. For this reason, since the waveform of the temperature change signal (dT/dt) changes similar to the waveform 204, no pulse appears in the judgment signal (CMP) 213 based on an output signal from the comparator. In this way, it is possible to simulate a temperature change signal in discharge failure state by setting a pulse width of a driving pulse whose energy is not enough to discharge ink.

Problem of Judgment of Discharge Status

FIGS. 6A to 6C are timing charts each showing the waveform of the temperature change signal (dT/dt) based on the temperature waveform signal detected by the temperature detection element.

FIG. 6A is a timing chart showing the profile of the temperature change when discharge judgment is performed correctly. The discharge inspection threshold voltage (TH) is set between the waveform 203 at the time of normal discharge and the waveform 204 at the time of a discharge failure. Therefore, by comparing the discharge inspection threshold voltage (TH) and the temperature change signal (dT/dt) with each other, the discharge status can be discriminated correctly.

As described above, the element substrate employs an arrangement in which the temperature detection element is provided immediately below the print element serving as a heating resistor (electrothermal transducer). This causes a manufacturing variation of the temperature detection element, a temporal change in resistance value of the temperature detection element by the influence of heat generated at the time of ink discharge, deterioration of the protection film of the print element by repeating an ink discharge operation, and a change in sensitivity of the temperature detection element by deposition of pigment or polymer contained in ink. This indicates that the detected temperature of the temperature detection element varies in accordance with the use of each print element. As a result of the variation, it may be impossible to judge the ink discharge status correctly.

FIG. 6B shows an example of a case in which, as a result of the distance between the print element and the temperature detection element being relatively shorter due to deterioration of the protection film of the print element or the like, a change in temperature on the print element is detected with high sensitivity. In this case, even if the preset discharge inspection threshold voltage (TH) and the temperature change signal (dT/dt) are compared with each other, the value of the waveform 204 is higher than the discharge inspection threshold voltage (TH) and normal discharge is erroneously judged, although the print element is actually in a discharge failure status.

FIG. 6C shows an example in which when the pigment or polymer component of ink is adhered/deposited onto the print element to form a deposition layer on the print element, the sensitivity of detecting a change in temperature on the print element decreases. In this case, even if the preset discharge inspection threshold voltage (TH) and the temperature change signal (dT/dt) are compared with each other, the value of the waveform 203 is lower than the discharge inspection threshold voltage (TH) and a discharge failure is erroneously judged, although the print element is actually in a normal discharge status.

As described above, since the sensitivity of the temperature detection element changes in accordance with the use of each print element, it may become impossible to detect the discharge status correctly.

To solve such a problem, a method of appropriately judging discharge status even if the sensitivity of the temperature detection element changes for each print element will be described.

After a description of an overview of discharge judgment processing, discharge inspection threshold value setting processing for preventing an erroneous judgment made due to a variation in discharge inspection threshold voltage caused by the use status of the print element, which is performed when discharge judgment processing using the temperature detection element is executed, will be described with reference to a flowchart shown in FIG. 8.

Figure 7:
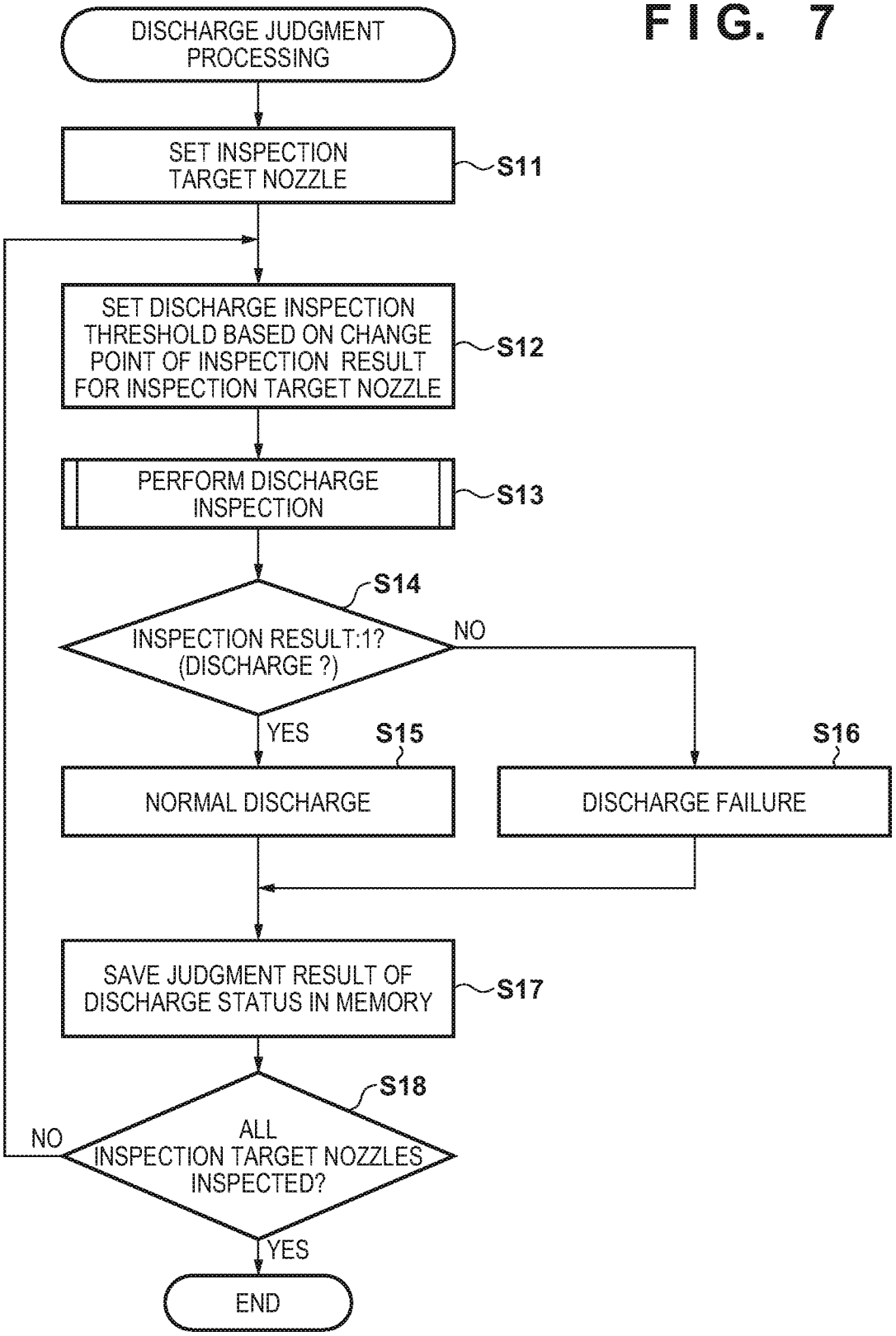
FIG. 7 is a flowchart illustrating an overview of discharge judgment processing.

FIG. 7 is a flowchart illustrating an overview of the discharge judgment processing. FIG. 8 is a flowchart illustrating processing of specifying a change point of discharge inspection.

The discharge judgment processing shown in FIG. 7 is executed at any desired timing, and judges the discharge status of each nozzle at the time of execution of the processing.

In step S11, a print controller 419 instructs an inspection target nozzle (print element), and a signal generation unit 7 selects the inspection target nozzle by a sensor selection signal SDATA in accordance with the instruction. In step S12, a discharge inspection threshold voltage (TH) is set based on the change point of the current inspection result of the selected nozzle. As the discharge inspection threshold voltage (TH), a voltage lower than the change point of the inspection result by a predetermined amount is set in consideration of the characteristic of the temperature detection element, the ink characteristic, a detection error, a variation of repetitive inspection, the tolerable variation of the change point of the inspection result, an update frequency, and the like.

This change point of the inspection result can be obtained by executing the processing of specifying a change point of discharge inspection (to be described later), and is updated at each predetermined timing. The predetermined timing is set by a paper feeding count, a print dot count, time, an elapsed period after last inspection, a timing for each print job, a timing for each print page, a timing of replacement of the printhead, a timing of recovery processing of the printhead, or the like, and is set appropriately in accordance with a system.

In step S13, discharge inspection is executed by using the discharge inspection threshold voltage (TH) calculated based on the change point of the inspection result. In step S14, it is checked whether the discharge status of the selected nozzle is a normal discharge status or a discharge failure status. If a judgment result signal RSLT is "1", the process advances to step S15, and it is judged that the selected nozzle is in the normal discharge status. On the other hand, if the judgment result signal RSLT is "0", the process advances to step S16, and it is judged that the selected nozzle is in the discharge failure status.

In step S17, the discharge status of the selected nozzle is saved in a RAM 421. In step S18, it is checked whether all target nozzles have been inspected. If it is determined that inspection is to continue, the process returns to step S11 to select another inspection target nozzle, and then the processes in step S12 and the subsequent steps are executed. On the other hand, if it is determined that inspection is to end, the discharge judgment processing ends.

After that, image quality correction control, recovery processing, and the like are executed in accordance with the discharge status judgment result.

A method of specifying the change point of the inspection result of each nozzle necessary to set the discharge inspection threshold value will be described next.

Figure 8:
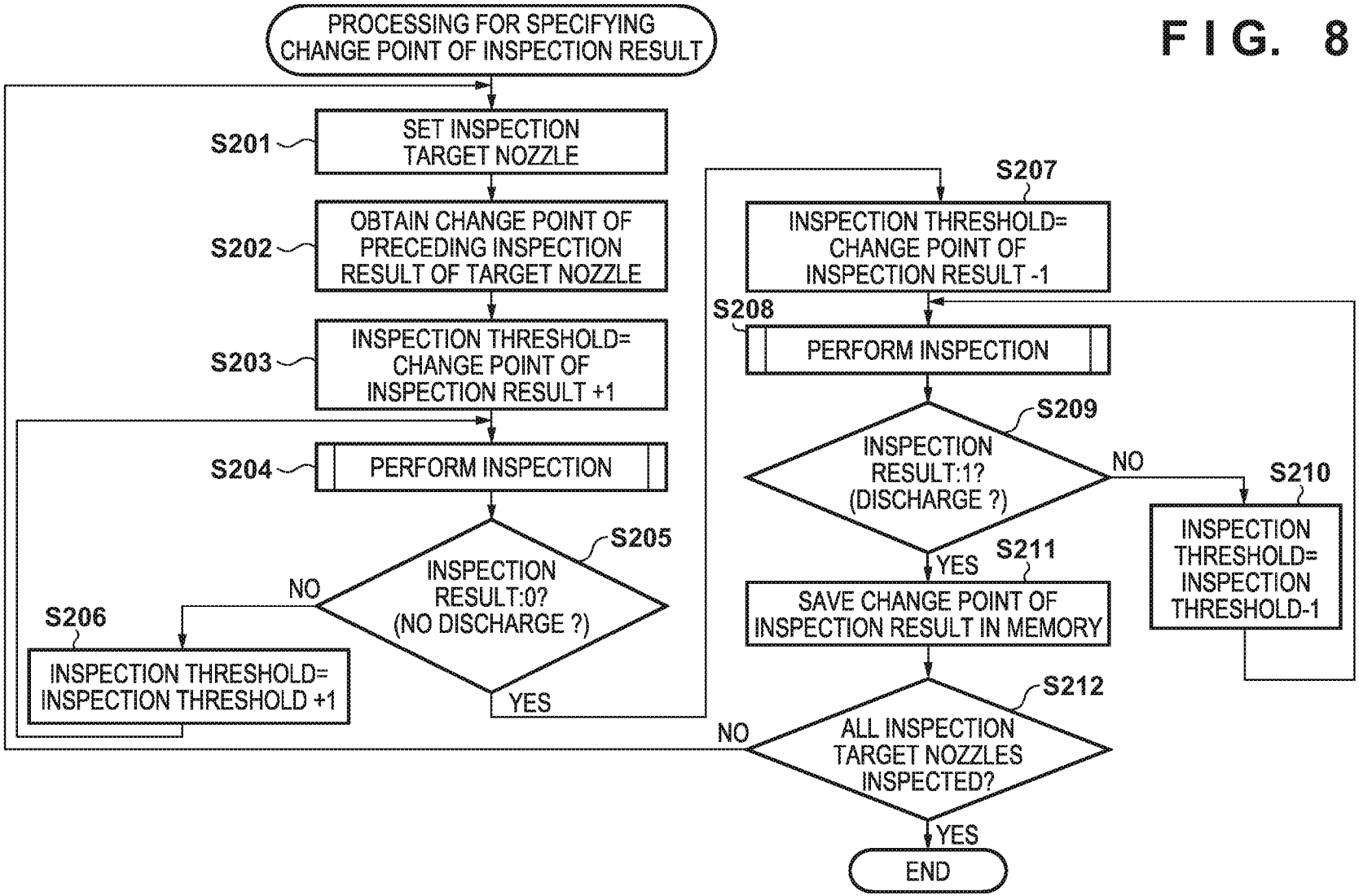
FIG. 8 is a flowchart illustrating processing of specifying a change point of an inspection result.

FIG. 8 is a flowchart illustrating processing of specifying a change point of an inspection result.

In step S201, a nozzle as a target of setting of a discharge inspection threshold value is set. This is done by performing the same processing as in step S11 of FIG. 7. In step S202, the discharge inspection threshold voltage (TH) corresponding to the change point of the last inspection result saved in advance in the non-volatile memory such as an EEPROM is read out, and set as the discharge inspection threshold voltage (TH) of the target nozzle.

As is apparent from FIGS. 5 to 6C, the discharge inspection threshold voltage (TH) is compared with the temperature change (dT/dt) of the detected temperature output from the temperature detection element. The value of this temperature change is physically expressed in units of mV/sec. In this embodiment, however, this value is quantumly expressed by 8 bits. Thus, the value of the discharge inspection threshold voltage (TH) is expressed by 8 bits.

In step S203, the discharge inspection threshold voltage (TH) of the target nozzle is set to a value obtained by incrementing the value obtained in step S202 by "1". The reason why the value is set in this way is that the change point of the inspection result is highly probably near the change point of the last inspection result.

After that, in step S204, discharge inspection is executed using the set discharge inspection threshold voltage (TH). In step S205, it is checked based on the set discharge inspection threshold voltage (TH) whether the discharge status of the selected nozzle is the normal discharge status or the discharge failure status. If the judgment result signal RSLT is "0", the process advances to step S207. On the other hand, if the judgment result signal RSLT is "1", the process advances to step S206. In step S206, the value of the discharge inspection threshold voltage (TH) is incremented by "1", and then the process returns to step S204.

As described above, in the processes of steps S204 to S206, it is checked whether a change point is found in the inspection result when increasing the value of the discharge inspection threshold voltage (TH) from the discharge inspection threshold voltage (TH) corresponding to the change point of the last inspection result.

Next, in step S207, the discharge inspection threshold voltage (TH) of the target nozzle is set to a value obtained by decrementing the value obtained in step S202 by "1". Next, in step S208, discharge inspection is executed using the set discharge inspection threshold voltage (TH), similar to step S203. In step S209, it is checked based on the set discharge inspection threshold voltage (TH) whether the discharge status of the selected nozzle is the normal discharge status or the discharge failure status. If the judgment result signal RSLT is "1", the process advances to step S211.

On the other hand, if the judgment result signal RSLT is "0", the process advances to step S210. In step S210, the value of the discharge inspection threshold voltage (TH) is decremented by "1", and then the process returns to step S208.

As described above, in the processes of steps S208 to S210, it is checked whether a change point is found in the inspection result when decreasing the value of the discharge inspection threshold voltage (TH) from the discharge inspection threshold voltage (TH) corresponding to the change point of the last inspection result.

With the above processing, by increasing/decreasing stepwise the value of the discharge inspection threshold voltage (TH) from the discharge inspection threshold voltage (TH) corresponding to the change point of the last inspection result, it is possible to specify a discharge inspection threshold voltage at which the discharge judgment result changes. The change point of the inspection result is synonymous with the value of the peak of the temperature change waveform.

In step S211, update processing is performed by setting, based on the change point of the inspection result in the EEPROM, the value of the discharge inspection threshold voltage (TH) when the judgment result signal RSLT becomes "1" in step S209 to the discharge inspection threshold voltage at which the newly obtained discharge inspection result changes. The next discharge status can be judged based on this value.

If a discharge inspection threshold voltage is set for the first time after the printhead is mounted, a default value or a discharge inspection threshold voltage obtained by the first measurement operation in a state in which there is no value is set. As the discharge inspection threshold voltage (TH), a voltage lower than the change point of the inspection result by a predetermined amount is set in consideration of the characteristic of the temperature detection element, the ink characteristic, a detection error, a variation of repetitive inspection, the tolerable variation of the change point of the inspection result, an update frequency, and the like. If the discharge inspection threshold voltage has a value of 255, a value lower than the voltage corresponding to the change point of the inspection result by about 5 is set. Note that the value of the discharge inspection threshold voltage (TH) corresponding to the change point of the inspection result may be determined as a new discharge inspection threshold voltage.

Lastly, in step S212, it is checked whether all the target nozzles have been inspected. If it is determined that inspection is to continue, the process returns to step S201 to select another inspection target nozzle, and then the processes in step S202 and the subsequent steps are executed. On the other hand, if it is determined that inspection is to end, the processing for specifying a change point of an inspection result ends.

As described above, in step S12 of FIG. 7, the discharge inspection threshold voltage (TH) is set based on the specified change point of the inspection result. However, if the nozzle when specifying the change point of the inspection result is in the discharge failure status, it is difficult to set an appropriate discharge inspection threshold voltage.

Therefore, in this embodiment, it is discriminated whether the nozzle is in the normal status or the discharge failure status, and processing of setting a discharge inspection threshold voltage is executed in accordance with a discrimination result.

Figure 9:
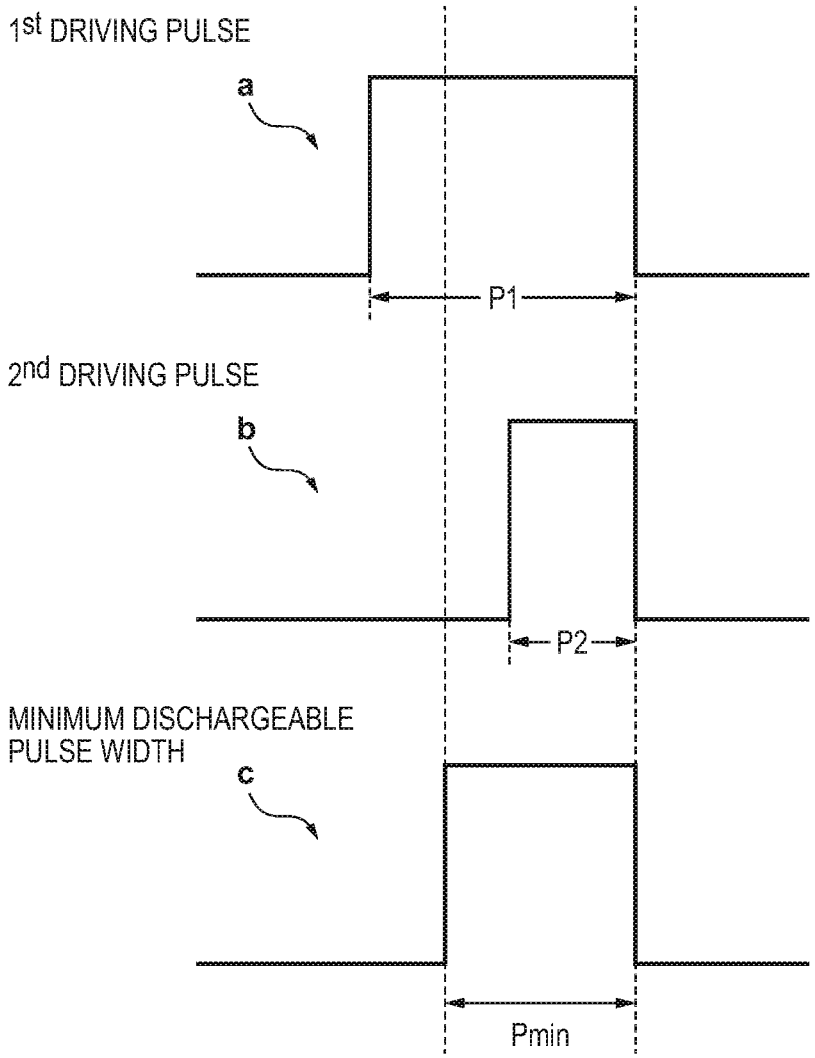
FIG. 9 is a view showing drive pulses applied to the print element used to judge the discharge status of the nozzle.

FIG. 9 is a view showing drive pulses applied to the print element used to judge the discharge status of the nozzle.

As described above, as the pulse width of a drive pulse is shortened, energy applied to ink of the nozzle decreases, and ink is not discharged from the nozzle by heating ink. Therefore, a minimum pulse width (Pmin) with which ink is dischargeable is defined for the drive pulse. If the pulse width of the drive pulse is equal to or longer than the minimum pulse width (Pmin), ink is discharged; otherwise, ink is not discharged.

In FIG. 9, a shows, as the first drive pulse, a drive pulse having a pulse width P1 equal to or longer than the minimum pulse width (Pmin), and b shows, as the second drive pulse, a drive pulse having a pulse width P2 shorter than the minimum pulse width (Pmin). Furthermore, c of FIG. 9 shows a drive pulse of the minimum pulse width (Pmin). The minimum pulse width (Pmin) is measured in advance, and the determined first and second drive pulses are saved in the EEPROM.

Figure 10:
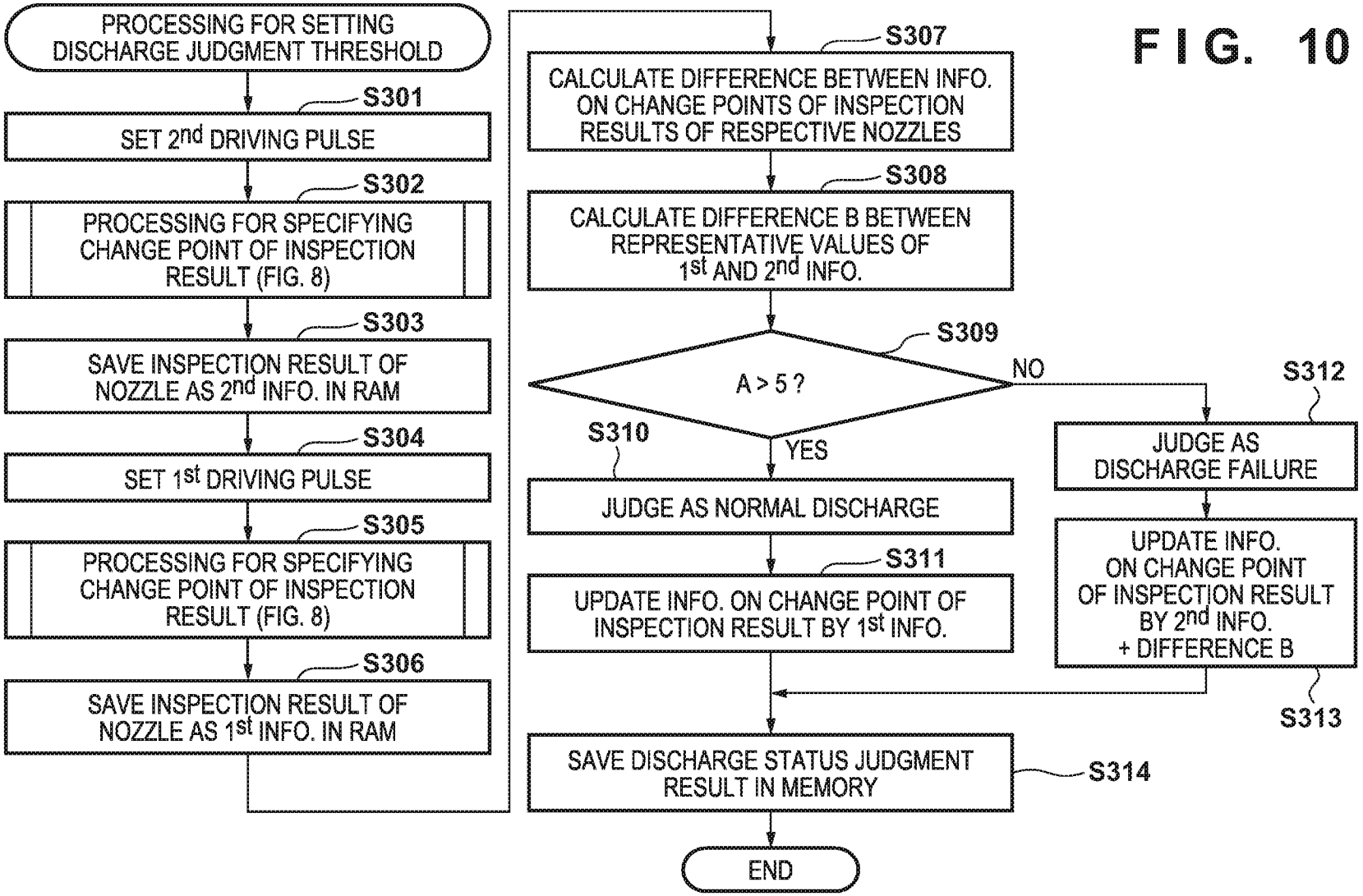
FIG. 10 is a flowchart illustrating processing of setting a discharge inspection threshold voltage.

FIG. 10 is a flowchart illustrating processing of setting the discharge inspection threshold voltage.

FIGS. 11A to 11C are schematic views for explaining the processing of setting the discharge inspection threshold voltage for sixteen (16) nozzles (seg0, . . . , seg4, . . . , seg11, . . . , seg15).

Figure 11:
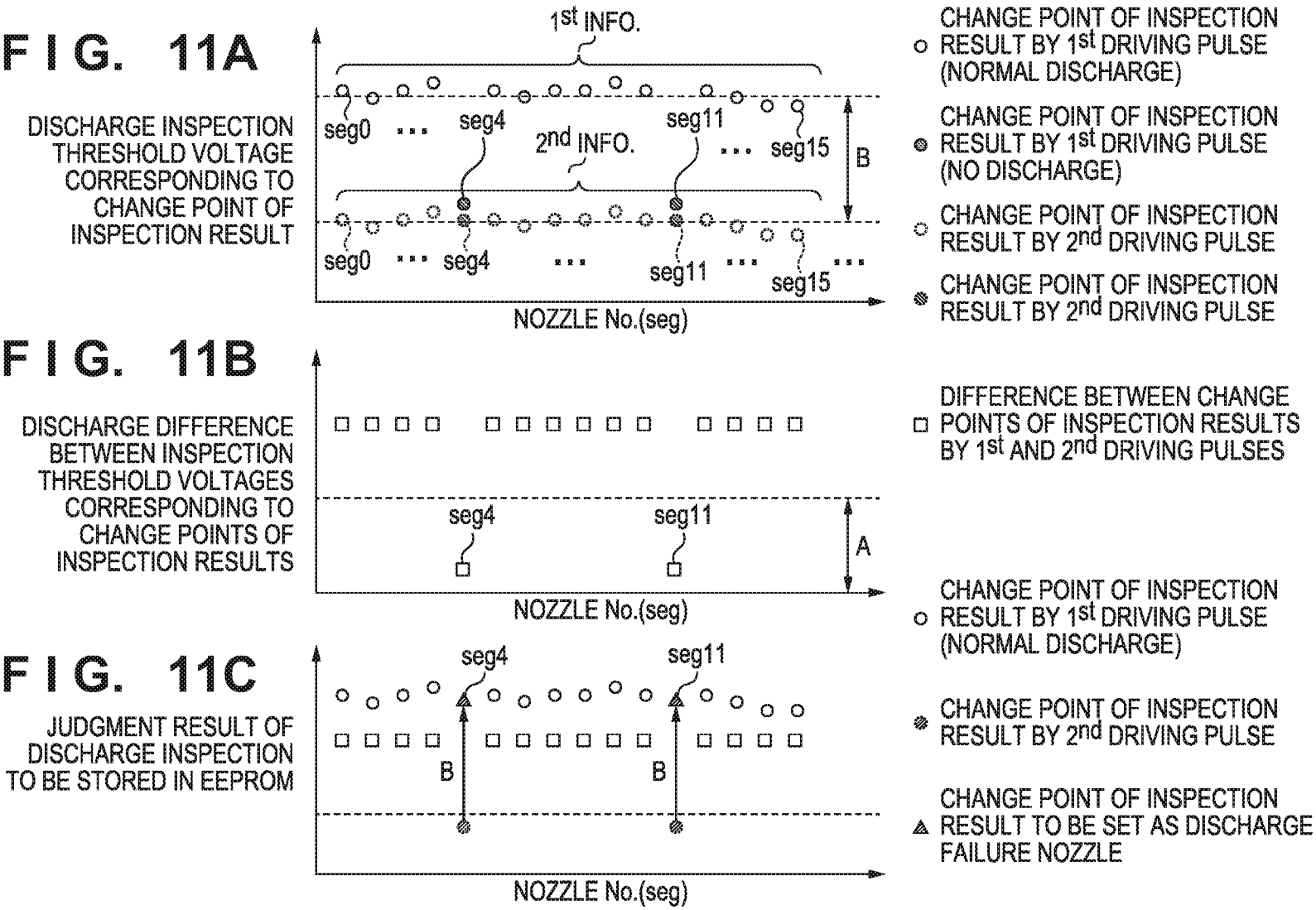
FIGS. 11A, 11B and 11C are schematic views for explaining the processing of setting the discharge inspection threshold voltage.

A method of discriminating whether the nozzle used to specify the change point of the inspection result in the processing shown in FIG. 8 is in the normal discharge status or the discharge failure status will be described with reference to FIGS. 10 to 11C.

In this example, change points of inspection results are specified using the two kinds of drive pulses (first and second drive pulses) shown in FIG. 9, and it is discriminated based on the specified change points of the inspection results whether the nozzle used to specify the change points of the inspection result is in the normal discharge status or the discharge failure status. For the nozzle discriminated to be in the discharge failure status, appropriate discharge status judgment processing is performed by setting a provisional change point of an inspection result.

Referring to FIG. 10, in step S301, the second drive pulse is set to drive an inspection target nozzle. In step S302, the processing for specifying a change point of an inspection result described with reference to FIG. 8 is executed using the set second drive pulse. In step S303, an inspection result for the inspection target nozzle is stored as the second information in the RAM 421.

In step S304, the first drive pulse is set to drive the inspection target nozzle. In step S305, the processing for specifying a change point of an inspection result described with reference to FIG. 8 is executed using the set first drive pulse. In step S306, an inspection result for the inspection target nozzle is stored as the first information in the RAM 421.

FIG. 11A shows discharge inspection threshold voltages corresponding to change points of inspection results obtained by inspecting the respective nozzles (seg0, . . . , seg15) using the first and second drive pulses. Referring to FIG. 11A, ○ and ● of solid lines represent results obtained when inspection is performed using the first drive pulse, and ○ and ● of dotted lines represent results obtained when inspection is performed using the second drive pulse. As shown in FIG. 11A, the value of the discharge inspection threshold voltage (second information) obtained when the second drive pulse is used is smaller than that of the discharge inspection threshold voltage (first information) obtained when the first drive pulse is used. As is apparent from FIG. 11A, the difference between the median value of the first information and that of the second information is represented by "B".

The value of the discharge inspection threshold voltage in the nozzle judged to be in the discharge failure status when inspection is performed using the first drive pulse is close to the value of the discharge inspection threshold voltage obtained when inspection is performed using the second drive pulse for the nozzle judged to be in the discharge failure status. This is because even if the drive pulses are different, the behavior of ink on the surface of the print element does not greatly change, and there is no large difference in thermal behavior on the surface of the print element. In the example shown in FIG. 11A, nozzles represented by seg4 and seg11 are judged to be in the discharge failure status.

Referring back to FIG. 10, in step S307, for each nozzle, the difference between the discharge inspection threshold voltage (first information) obtained by performing inspection using the first drive pulse and the discharge inspection threshold voltage (second information) obtained by performing inspection using the second drive pulse is calculated. FIG. 11B shows the value of the difference for each nozzle. As is apparent from FIG. 11B, for the nozzle (seg4 or seg11) judged to be in the discharge failure status, the value of the difference is small. Therefore, it is possible to discriminate, among the inspected nozzles, the nozzle in the normal discharge status or the discharge failure status by comparing the difference with a predetermined threshold value A.

In step S308, as shown in FIG. 11A, the difference B between the median value of the first information and that of the second information, which have been obtained by performing inspection using the second and first drive pulses in steps S303 and S306, respectively, is calculated. Note that in this example, the median value of the first information and that of the second information are used as representative values. However, another value (for example, an average value) may be used.

In step S309, a difference (D) between the first information and the second information is compared with the predetermined threshold value A for each nozzle. The threshold value A is set to "5" in this example but is set appropriately in accordance with the system. If the difference (D) is larger than the threshold value A (D>5), the process advances to step S310 to judge that the nozzle is in the normal discharge status. In step S311, as information about the change point of the inspection result of the nozzle, information (first information) about the change point of the inspection result obtained using the first drive pulse is saved in the EEPROM, as shown in FIG. 11C.

On the other hand, if the difference (D) is equal to or smaller than the threshold value (D≤5), the process advances to step S312 to judge that the nozzle is in the discharge failure status. In step S313, as information about the change point of the inspection result of the nozzle, the difference B and the information (second information) about the change point of the inspection result obtained using the second drive pulse are saved in the EEPROM, as shown in FIG. 11C. Note that in FIG. 11C, two nozzles (seg4 and seg11) are in the discharge failure status.

As described above, the pieces of information about the change points of the inspection results of all the nozzles can be updated. The updated pieces of information are reflected on the processing in step S12 of FIG. 7. A value lower than the discharge inspection threshold voltage by a predetermined value (in this example, 5 in the 255 stages), which corresponds to the sum of the second information and the difference B, is applied to seg4 and seg11 as a provisional value. If this provisional value is set for seg4 and seg11, the nozzles are judged to be in the discharge failure status in discharge inspection, and are never erroneously judged to be normal.

Note that in the above-described embodiment, the second drive pulse is a drive pulse having a pulse width shorter than the minimum pulse width (Pmin). However, if the difference (D) between the first information and the second information for the nozzle in the normal discharge status and the difference for the nozzle in the discharge failure status are identifiable, a pulse having a pulse width equal to or longer than the minimum pulse width (Pmin) may be employed as the second drive pulse. In this case, "pulse width (P1) of first drive pulse>pulse width (P2) of second drive pulse>minimum pulse width (Pmin)" is satisfied.

Lastly, in step S314, the judgment result of the discharge status saved in the EEPROM is updated by the judgment result of the discharge status of each nozzle. Note that for the nozzle judged to be in the discharge failure status, prohibition of discharge is set to reduce degradation in image quality as much as possible, and the nozzle is processed as an image quality correction control target nozzle.

Therefore, according to the above-described embodiment, each nozzle is inspected at each predetermined timing to check whether the change point of the inspection result varies, thereby setting an appropriate discharge inspection threshold voltage for each nozzle. Thus, even if the characteristic of the print element or the temperature detection element changes due to a different use status of each print element, it is possible to correctly judge the discharge status of each print element, and always perform satisfactory image printing.

Another Embodiment

As for the processing described above with reference to FIG. 10, the discharge judgment threshold value setting processing when the printhead is newly attached has been explained. However, if, after the printhead is attached, the printhead is used and a time elapses, it is not necessary to execute the discharge judgment threshold value setting processing according to FIG. 10. As another embodiment, discharge judgment threshold value setting processing assuming that a printhead has been attached and used and a time has elapsed will be described.

Figure 12:
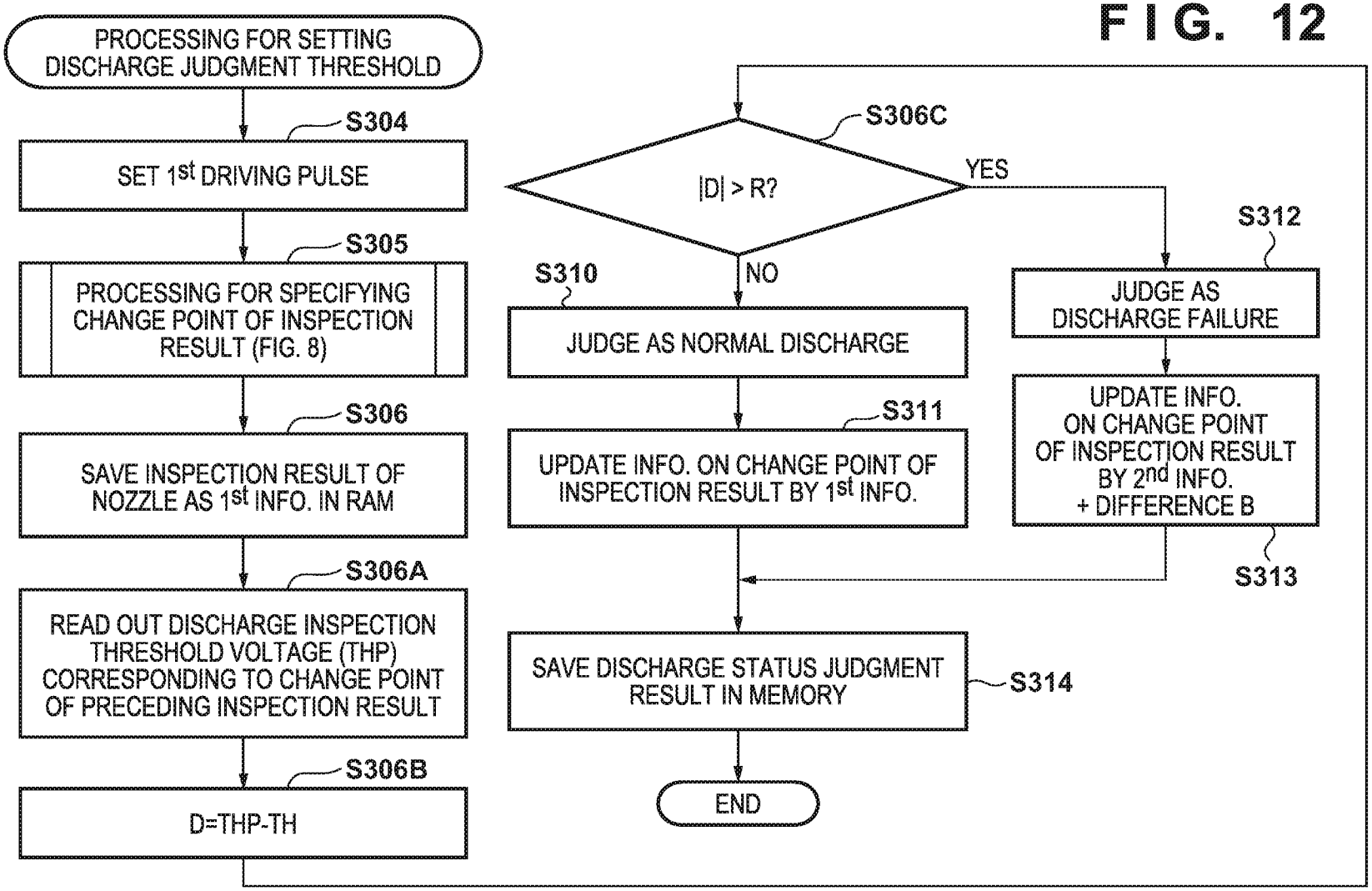
FIG. 12 is a flowchart illustrating processing of setting a discharge inspection threshold voltage according to another embodiment.

FIG. 12 is a flowchart illustrating the discharge judgment threshold value setting processing according to the other embodiment. Note that in FIG. 12, the same step numbers as those already described with reference to FIG. 10 denote the same processing steps, and a description thereof will be omitted. Only processes unique to this embodiment will be described.

Referring to FIG. 12, steps S304 to S306 are executed.

In step S306A, a discharge inspection threshold voltage (THP) corresponding to a change point of a last inspection result saved in advance in a non-volatile memory such as an EEPROM is read out. In step S306B, a difference (D) from a discharge inspection threshold voltage (TH) corresponding to a change point of an inspection result obtained in inspection in step S306 is calculated. This processing is performed for each orifice.

Assume that last judgment processing is performed when a printhead is newly attached, and the current processing is the second discharge inspection threshold voltage (TH) setting processing. In this case, for an orifice judged last time to be in the normal discharge status, the first information obtained in the last judgment processing is saved. On the other hand, for an orifice judged to be in the discharge failure status, the sum of the second information and a difference B is saved. The difference between a discharge inspection threshold voltage corresponding to the saved information and the discharge inspection threshold voltage obtained in the current processing is calculated.

In step S306C, it is checked whether the absolute value (|D|) of the calculated difference is larger than a predetermined range (R). If the absolute value of the difference falls within the predetermined range, the process advances to step S310. Then, the process advances to step S311, and information on the change point of the inspection result is saved in the EEPROM to be updated by the first information obtained in the current processing.

On the other hand, if (|D|) falls outside the predetermined range, the process advances to step S312 (discharge failure judgment) not to update information on the change point of the inspection result of the nozzle.

If the discharge determination threshold value setting processing is performed at a predetermined timing, the processing according to FIG. 12 described above is performed. In the second or subsequent processing, the difference (D) between the discharge inspection threshold voltage (TH) corresponding to the change point of the inspection result obtained in inspection in step S306 and the discharge inspection threshold voltage (THP) corresponding to the change point of the last inspection result is calculated. However, a difference from a discharge inspection threshold voltage corresponding to a change point of a past inspection result instead of the change point of the last inspection result is calculated, and a difference from an inspection result before the last or from a representative value such as a maximum, minimum, or average value of the history of the change points of the past inspection results may be calculated.

By executing the processing shown in FIG. 12 in this way, an orifice in the discharge failure status can be specified. After that, by executing the processing shown in FIG. 12 described above, it is possible to obtain a change point of an inspection result by one kind of drive pulse, and thus processing of updating a discharge inspection threshold voltage can be performed at high speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-062263, filed Mar. 28, 2018, which is hereby incorporated by reference herein in its entirety.

What is claimed is:

1. A printing apparatus comprising:

a printhead including a plurality of nozzles each having an opening and configured to discharge liquid, a plurality of energy generating elements respectively provided in the plurality of nozzles and each configured to generate energy used for discharging the liquid through the corresponding opening by application of a pulse, and an output unit configured to output a signal indicating a liquid state between one of the openings and the corresponding energy generating element in a case in which the pulse is applied to the energy generating element;

a drive unit configured to drive, by a first pulse and a second pulse whose waveform is different from a waveform of the first pulse, the energy generation element provided in a target nozzle of the plurality of nozzles;

an inspection unit configured to inspect the liquid discharge status, based on the signal output from the output unit, by using a threshold value for judging the liquid discharge status of the target nozzle in a state in which the energy generating element provided in the target nozzle is driven by the drive unit by the first pulse and the second pulse;

an obtaining unit configured to obtain, for the target nozzle, first information regarding a change point at which a judgment result obtained by inspecting the liquid discharge status by the inspection unit changes in the state in which the energy generating element provided in the target nozzle is driven by the drive unit by the first pulse and second information regarding a change point at which a judgment result obtained by inspecting the liquid discharge status by the inspection unit changes in the state in which the energy generating element provided in the target nozzle is driven by the drive unit by the second pulse; and a setting unit configured to set, based on the first information and the second information obtained by the obtaining unit, the threshold value for judging the liquid discharge status of the target nozzle.

2. The apparatus according to claim 1, further comprising:

a comparison unit configured to compare a difference between the first information and the second information with a predetermined threshold value; and a judgment unit configured to judge the liquid discharge status of the target nozzle based on a result of the comparison of the comparison unit.

3. The apparatus according to claim 2, further comprising a storage unit configured to store the threshold value for judging the liquid discharge status in correspondence with each nozzle, wherein the setting unit updates the threshold value stored in the storage unit.

4. The apparatus according to claim 3, wherein if the difference is greater than the predetermined threshold value, the judgment unit judges normal discharge for the nozzle inspected by the inspection unit, and if the difference is not greater than the predetermined threshold value, the judgment unit judges discharge failure for the nozzle inspected by the inspection unit.

5. The apparatus according to claim 4, wherein the storage unit further stores information indicating a nozzle in a normal discharge status and a nozzle in a discharge failure status based on a judgment result by the judgment unit.

6. The apparatus according to claim 4, wherein the change point indicates one of a point at which the judgment result changes from normal discharge to discharge failure and a point at which the judgment result changes from discharge failure to normal discharge.

7. The apparatus according to claim 3, wherein the inspection unit changes stepwise the threshold value by a predetermined value from a threshold value obtained in a last inspection and stored in the storage unit, each time an inspection is to be made.

8. The apparatus according to claim 1, wherein a pulse width of the first pulse is shorter than a minimum pulse width with which liquid is dischargeable from the nozzle.

9. The apparatus according to claim 1, wherein inspection by the inspection unit is performed at least at one of a timing set by a paper feeding count, a timing set by a print dot count, an elapsed period after a last inspection, a timing of replacement of the printhead, a timing of recovery processing of the printhead, a timing for each print job, and a timing for each print page.

10. The apparatus according to claim 1, wherein the output unit of the printhead compares the threshold value set by the setting unit and information indicating the liquid state of the target nozzle, judges the liquid state of the target nozzle based on a result of the comparison, and outputs the signal.

11. The apparatus according to claim 10, wherein the information indicates a temporal change in the signal obtained from the output unit.

12. The apparatus according to claim 1, further comprising a selection unit configured to select, from the plurality of nozzles of the printhead, a nozzle as a target of inspection of a liquid discharge status.

13. The apparatus according to claim 12, wherein the selection unit selects part of the plurality of nozzles as an inspection target of the inspection unit.

14. The apparatus according to claim 1, wherein the plurality of energy generating elements are heat generating elements which generate heat.

15. The apparatus according to claim 1, wherein a pulse width of the first pulse is different from a pulse width of the second pulse.

16. A discharge status judgment method for a printing apparatus comprising a printhead including a plurality of nozzles each having an opening and configured to discharge liquid, a plurality of energy generating elements respectively provided in the plurality of nozzles and each configured to generate energy used for discharging the liquid through the corresponding opening by application of a pulse, and an output unit configured to output a signal indicating a liquid state between one of the openings and the corresponding energy generating element in a case in which the pulse is applied to the energy generating element, the method comprising:

inspecting the liquid discharge status, based on the signal output from the output unit, by using a threshold value for judging the liquid discharge status of a target nozzle in a state in which the energy generating element provided in the target nozzle is driven by a first pulse and a second pulse whose waveform is different from a wave form of the first pulse;

obtaining, for the target nozzle, first information regarding a change point at which a judgment result obtained by inspecting the liquid discharge status using the first pulse changes and second information regarding a change point at which a judgement result obtained by inspecting the liquid discharge status using the second pulse changes; and setting, based on the obtained first information and second information, the threshold value for judging the liquid discharge status of the target nozzle.

17. The method according to claim 16, further comprising:

comparing a difference between the first information and the second information with a predetermined threshold value; and judging the liquid discharge status of the target nozzle based on a result of the comparison.

18. The method according to claim 17, further comprising storing, in a memory, the threshold value for judging the liquid discharge status in correspondence with each nozzle, wherein in the setting, the threshold value stored in the memory is updated.

19. The method according to claim 18, wherein in the judging, if the difference is greater than the predetermined threshold value, normal discharge is judged for the inspected nozzle, and if the difference is not greater than the predetermined threshold value, discharge failure is judged for the inspected nozzle.

20. The method according to claim 19, wherein the memory further stores information indicating a nozzle in a normal discharge status and a nozzle in a discharge failure status based on a result of the judgment.

21. The method according to claim 19, wherein the change point indicates one of a point at which the judgment result changes from normal discharge to discharge failure and a point at which the judgment result changes from discharge failure to normal discharge.

22. The method according to claim 18, wherein in the inspecting, the threshold value is changed stepwise by a predetermined value from a threshold value obtained in a last inspection and stored in the memory, each time an inspection is to be made.

23. The method according to claim 16, wherein a pulse width of the first pulse is shorter than a minimum pulse width with which liquid is dischargeable from the nozzle.

* * * * *